US009931259B2

(12) United States Patent
Ottenweller et al.

(10) Patent No.: US 9,931,259 B2
(45) Date of Patent: Apr. 3, 2018

(54) DRIVE SYSTEM FOR BED

(71) Applicant: Gendron, Inc., Bryan, OH (US)

(72) Inventors: Paul Ottenweller, Bryan, OH (US); Isaac W. Martin, Bryan, OH (US)

(73) Assignee: GENDRON, INC., Bryan, OH (US)

( * ) Notice: Subject to any disclaimer, the term of this patent is extended or adjusted under 35 U.S.C. 154(b) by 0 days.

(21) Appl. No.: 15/149,285

(22) Filed: May 9, 2016

(65) Prior Publication Data

US 2016/0250090 A1 Sep. 1, 2016

Related U.S. Application Data

(63) Continuation of application No. 14/505,841, filed on Oct. 3, 2014, now Pat. No. 9,358,169.

(Continued)

(51) Int. Cl.

| | |
|---|---|
| ***A61G 7/08*** | (2006.01) |
| ***A61G 7/05*** | (2006.01) |
| ***A61G 7/053*** | (2006.01) |
| *A61G 7/012* | (2006.01) |
| *A61G 7/015* | (2006.01) |
| *A61G 7/018* | (2006.01) |
| *A61G 7/10* | (2006.01) |

(52) U.S. Cl.

CPC ..... *A61G 7/08* (2013.01); *A61G 7/0506* (2013.01); *A61G 7/0528* (2016.11); *A61G 7/0533* (2013.01); *A61G 7/012* (2013.01); *A61G 7/015* (2013.01); *A61G 7/018* (2013.01); *A61G 7/108* (2013.01); *A61G 2200/16* (2013.01); *A61G 2203/14* (2013.01); *A61G 2220/16* (2013.01)

(58) Field of Classification Search

CPC .. A61G 7/08; A61G 7/018; A61G 2007/0509; A61G 2007/051; A61G 2007/0519; B62D 51/04

USPC ..... 180/19.1

See application file for complete search history.

(56) References Cited

U.S. PATENT DOCUMENTS 3,077,613 A * 2/1963 Mayer ..... A61G 7/0533 212/179

3,868,734 A * 3/1975 Benoit ..... A61G 7/0533 482/139

(Continued)

*Primary Examiner* — Joseph M Rocca
*Assistant Examiner* — Michael R Stabley
(74) *Attorney, Agent, or Firm* — Shumaker, Loop & Kendrick, LLP; James D. Miller

(57) ABSTRACT

A bariatric patient management system includes a single-wheel drive system having bi-directional variable speed control through use of a variable control joystick. The single-wheel drive system is disposed on an underside of the bariatric patient management system and engages a floor surface when the bariatric bed is in a lowermost position. The bariatric patient management system further includes a removable headboard having a disconnect feature for disconnecting the variable control joystick from the single-wheel drive system when the headboard is removed. A plurality of three-setting casters is used in conjunction with the single-wheel drive to allow the bariatric patient management system to be manually turned when transported from one location to another. The bariatric patient management system further includes an improved trapeze boom that allows for additional access to a patient adjacent the headboard of the bariatric patient management system.

6 Claims, 7 Drawing Sheets

Related U.S. Application Data

(60) Provisional application No. 61/887,056, filed on Oct. 4, 2013.

(56) References Cited

U.S. PATENT DOCUMENTS 4,253,207 A * 3/1981 Marcyan ..... A61G 7/0533 5/84.1
4,340,984 A * 7/1982 Marcyan ..... A47C 19/005 5/285
4,439,879 A * 4/1984 Werner ..... A61G 7/00 5/600
5,337,845 A * 8/1994 Foster ..... A61G 7/00 180/11
5,964,313 A * 10/1999 Guy ..... B60L 3/02 180/19.1
6,330,926 B1 * 12/2001 Heimbrock ..... A61G 7/018 180/65.1
6,481,688 B1 * 11/2002 Welling ..... A61G 7/05 248/276.1
6,749,034 B2 * 6/2004 Vogel ..... A61G 7/018 180/19.1
6,772,850 B1 * 8/2004 Waters ..... A61G 7/08 180/65.51
6,791,460 B2 * 9/2004 Dixon ..... A61G 7/05 340/5.1
6,877,572 B2 * 4/2005 Vogel ..... A61G 7/00 180/15
7,083,012 B2 * 8/2006 Vogel ..... A61G 7/00 180/15
7,191,854 B2 * 3/2007 Lenkman ..... A61G 7/08 180/19.1
7,419,019 B1 * 9/2008 White ..... A61G 7/08 180/19.1
7,536,738 B2 * 5/2009 Richards ..... A61G 7/0533 5/662
7,568,247 B2 * 8/2009 Strobel ..... A61G 7/05 5/613
7,690,059 B2 * 4/2010 Lemire ..... A61G 7/005 5/600
7,789,187 B2 * 9/2010 Zerhusen ..... A61G 7/05 180/19.1
7,882,582 B2 * 2/2011 Kappeler ..... A61G 7/018 5/510
8,400,311 B2 * 3/2013 Dixon ..... A61G 7/0528 340/286.07
8,442,738 B2 * 5/2013 Patmore ..... A61G 1/048 180/19.1
8,701,229 B2 4/2014 Lemire et al.
8,752,659 B1 * 6/2014 Lenkman ..... B60G 17/0526 180/19.1
2006/0179576 A1 * 8/2006 Richards ..... A61G 7/0533 5/662
2009/0014219 A1 * 1/2009 Springston ..... B62B 3/008 180/19.1
2012/0086575 A1 * 4/2012 Dixon ..... A61G 7/0528 340/573.4

* cited by examiner

DRIVE SYSTEM FOR BED

CROSS-REFERENCE TO RELATED APPLICATIONS

This application is a continuation application of U.S. patent application Ser. No. 14/505,841, filed on Oct. 3, 2014, which claims priority to U.S. Provisional Application Ser. No. 61/887,056, filed on Oct. 4, 2013, the entire disclosures of which are hereby incorporated herein by reference.

FIELD OF THE INVENTION

The present invention relates to a portable patient bed, and more particularly to a bariatric patient bed having a single-wheel drive system for transporting the bariatric patient bed.

BACKGROUND OF THE INVENTION

Bariatrics is typically defined as the branch of medicine concerned with the management of obesity and allied diseases. When working with patients in need of bariatric services and procedures, it has been found necessary to deal with persons weighing up to and exceeding one thousand pounds. Accordingly, it has become necessary to develop beds, stretchers, chairs, and/or tables capable of supporting the weight of persons weighing up to and exceeding one thousand pounds.

When dealing with patients of an elevated weight, it has been found that hospital beds for use with bariatric patients may be advantageously equipped with a drive system to aid a health care professional in easily transporting the bariatric patient from one location to another. Such drive systems may consist of a pair of wheels being driven in unison by one or more actuators. Subsequently, bariatric beds having the dual drive wheel system cannot be manually maneuvered effectively. The weight of the bariatric bed while carrying a patient makes manual steering adjustments increasingly difficult to perform when both drive wheels are engaged with a floor surface. Because a health care professional cannot easily turn the bariatric bed manually, often times additional components must be added to allow for motorized steering of the dual-wheel drive systems. This often results not only in added complexity and cost in manufacturing such dual-drive wheel systems, but it also requires that the dual-wheel drive system have advanced controls such as a multi-axis joystick, adding even more complexity and cost to the system.

Furthermore, many existing bariatric beds also feature a patient trapeze that extends up and over a surface of the bariatric bed supporting the patient to aid in lifting or repositioning the patient. These patient trapeze devices often consist of a pole originating from multiple supports that are adjacent and extend above a headboard of the bariatric bed. The position of the bed's headboard relative to the patient trapeze may limit access to the patient from a direction outside of and adjacent the headboard. Furthermore, the multiple supports for the patient trapeze present an additional obstacle for a healthcare professional attempting to gain access to the patient from behind the headboard.

It would therefore be desirable to produce a patient bed having a drive system capable of transporting the bariatric bed in a manner having increased maneuverability. It would also be desirable to produce a bariatric bed having a patient trapeze that does not limit access to the patient from a direction adjacent an outside surface of the headboard of the bariatric bed.

SUMMARY OF THE INVENTION

Concordant and congruous with the present invention, a patient bed having a single-wheel drive system and an improved trapeze boom has surprisingly been discovered.

In an embodiment of the invention, a drive system for a portable bed having a frame is disclosed, the drive system comprising a mounting bracket securely coupled to the frame and including a first spring guide, wherein a first sliding block is slidably disposed within the first spring guide. The drive system further comprises a motor mount assembly having an actuator coupled thereto, wherein the motor mount assembly is rotatably coupled to the first sliding block, a ground engaging wheel driven by the actuator, and a toggle mount assembly having a first end and a second end, the first end rotatably coupled to the motor mount assembly and the second end rotatably coupled to the frame of the bed.

In another embodiment of the invention, a bariatric patient management system comprises a frame having a first end and a second end, a plurality of ground engaging casters disposed on the frame, and a drive system disposed on the frame. The drive system comprises a mounting bracket securely coupled to the frame and including a first spring guide, wherein a first sliding block is slidably disposed within the first spring guide. The drive system further comprises a motor mount assembly having an actuator coupled thereto, wherein the motor mount assembly is rotatably coupled to the first sliding block, a ground engaging wheel driven by the actuator, and a toggle mount assembly having a first end and a second end, the first end rotatably coupled to the motor mount assembly and the second end rotatably coupled to the frame of the bed.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF EXEMPLARY EMBODIMENTS OF THE INVENTION

Figure 1:
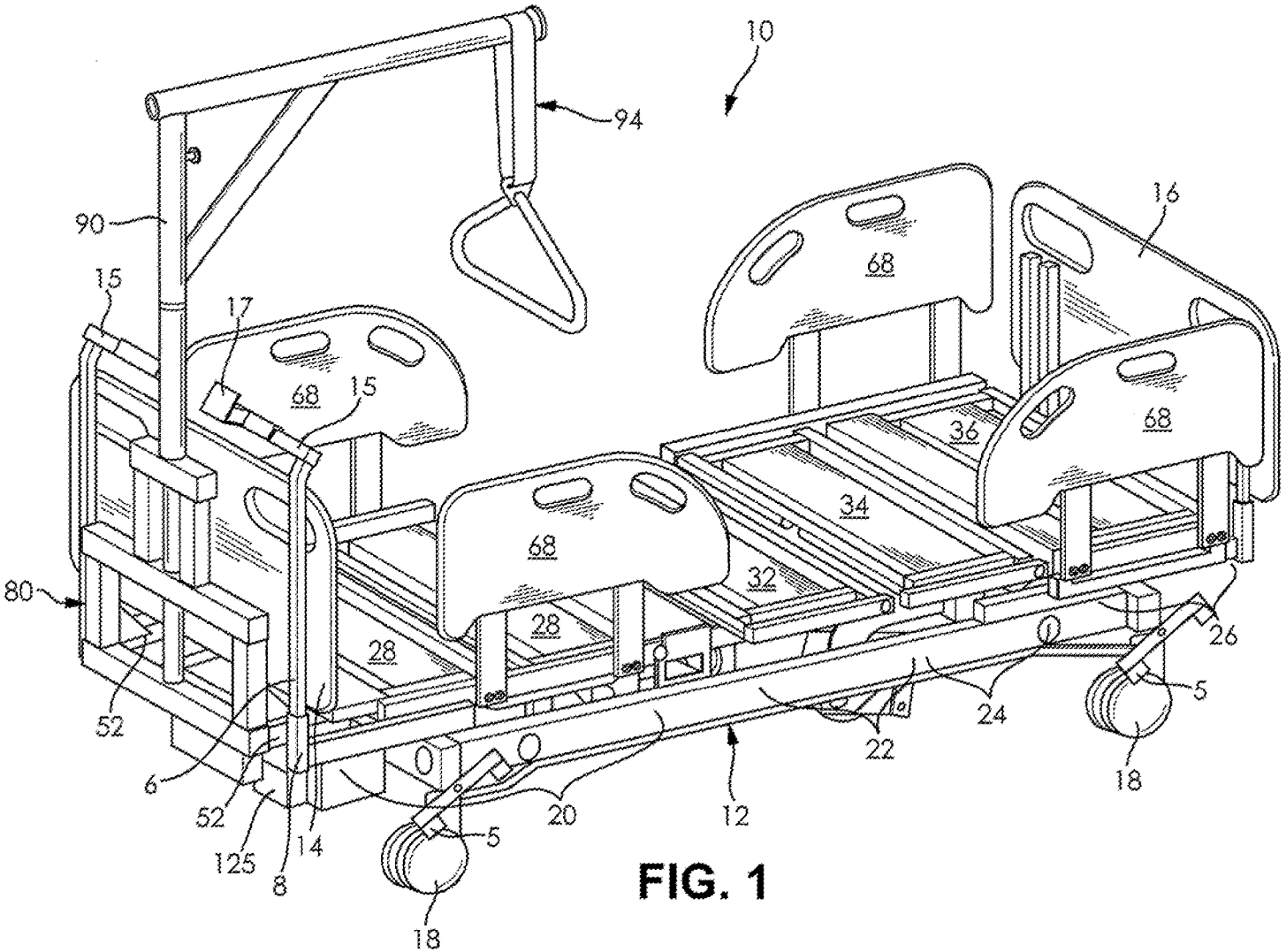
FIG. 1 is a top perspective view of a bariatric patient management system for supporting a bariatric patient in accordance with the present invention.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-7 show an embodiment of a bariatric patient management system 10. The bariatric patient management system 10 includes a body supporting main frame 12, a headboard 14, a footboard 16, and ground engaging casters 18 for supporting a patient, as clearly illustrated in FIGS. 1-3. The bariatric patient management system 10 further includes a single-wheel drive system 110 and a trapeze support structure 80.

The main frame 12 can be of solid or split construction and includes a backrest section 20, a middle section 22, a leg section 24, and a foot section 26. The backrest section 20, the middle section 22, the leg section 24, and the foot section 26 cooperate to form a mattress supporting surface for the bariatric patient management system 10. The backrest section 20 includes a pair of backrest panels 28 forming a substantially planar surface for supporting a patient. The backrest section 20 may, however, be formed of one backrest panel 28 or more than two of the backrest panels 28, for example. Each of the middle section 22, the leg section 24, and the foot section 26 includes at least one respective middle panel 32, leg panel 34, and foot panel 36.

Figure 2:
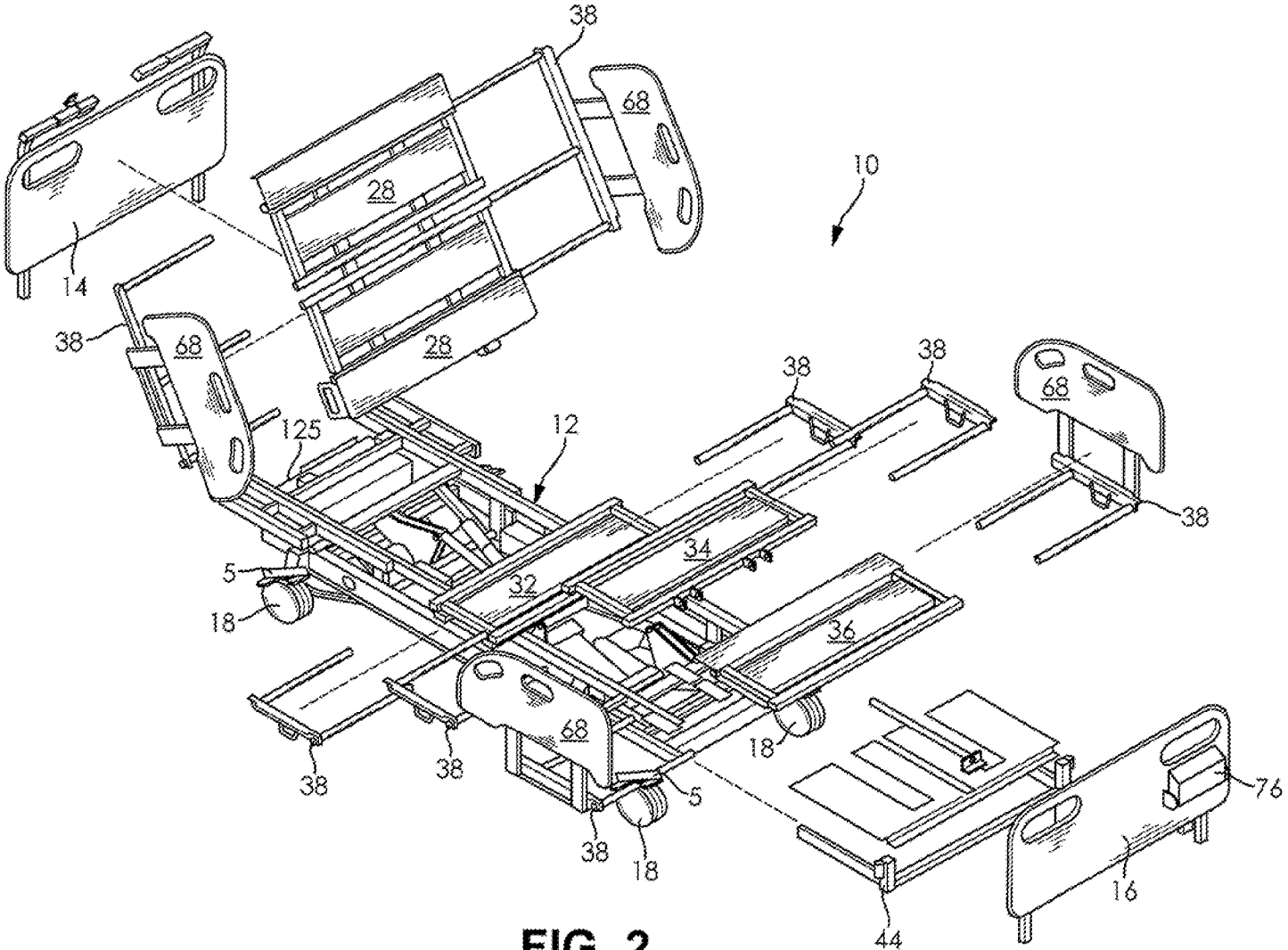
FIG. 2 is a partially exploded top perspective view of the bariatric patient management system illustrated in FIG. 1.

Both a first side and a second side of each of the backrest section 20, the middle section 22, the leg section 24, and the foot section 26 include an extensible side pull out extension 38, as best shown in FIG. 2. In the embodiment shown, the side pull out extensions 38 telescope outwardly. A plurality of locking apertures (not shown) are disposed in the side pull out extension 38. A spring loaded locking pin (not shown) is disposed on the respective sections 20, 22, 24, 26 and cooperates with the apertures to lock the side pull out extension 38 in a desired position. Other locking means may be used without departing from the scope and spirit of the invention. An extensible end pull out extension 44 is provided at an end of the main frame 12 adjacent the foot section 26, and the end pull out extension 44 telescopes outwardly in a similar fashion to the side pull out extensions 38. A plurality of locking apertures (not shown) are disposed in the end pull out extension 44. A spring loaded locking pin (not shown) is disposed on the main frame 12 and cooperates with the apertures to lock the end pull out extension 44 in a desired position. Other locking means may be used without departing from the scope and spirit of the invention. An extensible end pull out extension 44 can also be provided at an end of the main frame 12 adjacent the backrest section 20 in some embodiments.

Figure 3:
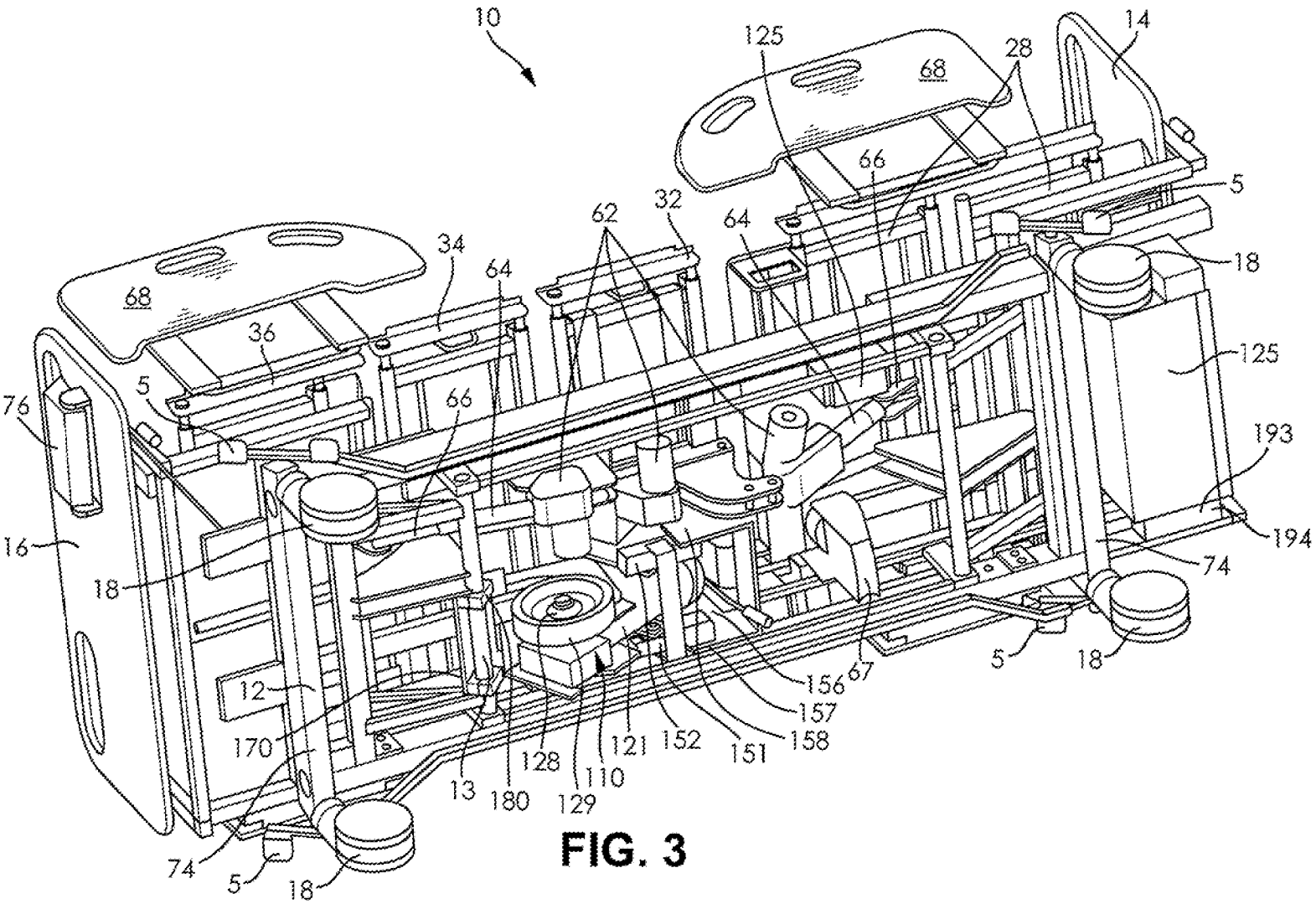
FIG. 3 is a bottom perspective view of the bariatric patient management system illustrated in FIG. 1.

Referring now to FIG. 3, there is shown a plurality of actuators 62. Each of the actuators 62 may include an actuator arm 64 operatively engaged with a linkage member 66. The linkage member 66 operatively links the actuator arm 64 with a respective one of the backrest section 20, the middle section 22, the leg section 24, the foot section 26, and the main frame 12 to cause an inclination of the respective one of the backrest section 20, the middle section 22, the leg section 24, the foot section 26, and the main frame 12 upon actuation of the actuator arm 64. A controller 67 is provided to control actuation of the actuators 62. The actuators 62 can be a push type actuator, a pull type actuator, or a push/pull type actuator as desired. In the embodiment shown, the actuators 62 are push/pull type actuators. It is understood that electrical actuators, hydraulic actuators, a combination thereof, or other actuators can be used without departing from the scope and spirit of the invention.

FIGS. 1-3 show a pair of side rail panels 68 adjustably connected to each side of the main frame 12 adjacent the backrest section 20 for the safety of the patient. The side rail panels 68 can be placed in multiple positions. To facilitate transport, the side rail panels 68 can be dropped down into the main frame 12 to facilitate a width of 39 inches to fit through a standard 42-inch door, for example.

A load cell (not shown) is connected to each of the casters 18 and may be disposed within a cross member 74 that is connected to the main frame 12. The load cell may be coupled to the cross member 74 and the caster 18 may be coupled to the load cell by any conventional fastening method such as threaded fasteners, for example. Thus, the load of the bariatric patient management system 10 is transmitted through the load cell. The load cell is electrically connected to a weight display unit 76, as shown in FIGS. 2 and 3, such that a weight signal sent from the load cell to the weight display unit 76 can be shown.

A trapeze support structure 80 is disposed on an end of the main frame 12 adjacent the backrest section 20, as best illustrated in FIG. 1. A pair of outwardly extending arms 52 of the trapeze support structure 80 are received adjacent the main frame 12 and fastened thereto by any conventional fastening method such as threaded fasteners, for example. The outwardly extending arms 52 may be C-channels for resting on a portion of the main frame 12 before being coupled thereto, but it should be understood that the outwardly extending arms 52 may have any suitable shape and form for coupling the trapeze support structure 80 to the main frame 12.

Figure 4:
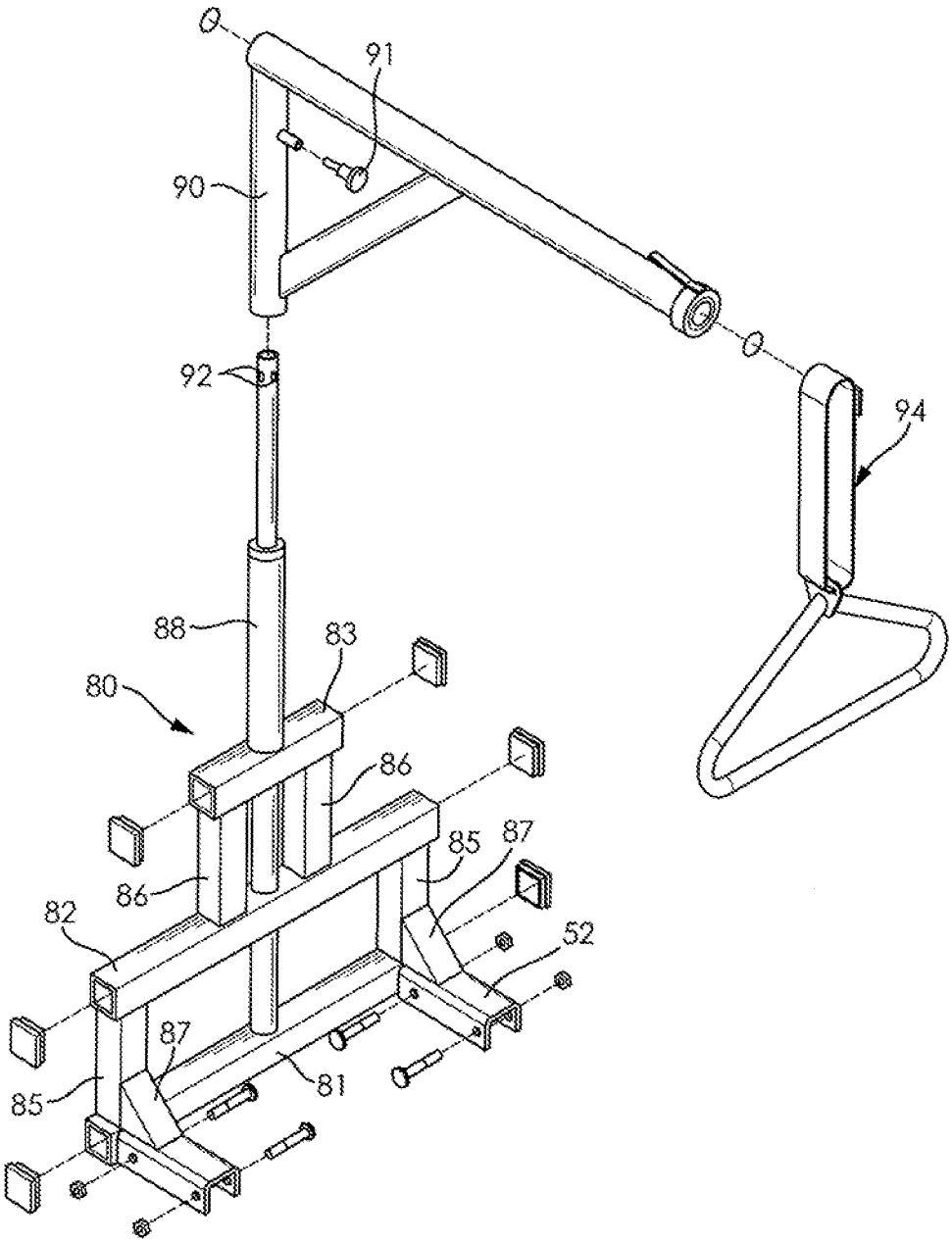
FIG. 4 is a partially exploded top perspective view of a trapeze boom for use with the bariatric patient management system illustrated in FIG. 1.

Referring now to FIG. 4, the trapeze support structure 80 further comprises a first cross bar 81, a second cross bar 82, and a third cross bar 83. The first cross bar 81 extends between and is coupled to each of the outwardly extending arms 52. The second cross bar 82 is spaced apart from the first cross bar 81 vertically and is supported by a plurality of first support beams 85 extending between the first cross bar 81 and the second cross bar 82. The first support beams 85 disposed at each end of the first cross bar 81 may be coupled to a corresponding one of the outwardly extending arms 52 through use of a support bracket 87 used to provide additional structural support to the trapeze support structure 80.

A plurality of second support beams 86 is disposed between and coupled to each of the second cross bar 82 and the third cross bar 83. As shown in FIG. 4, the first cross bar 81 and the second cross bar 82 each have substantially the same length while the third cross bar 83 may have a smaller length relative to the first cross bar 81 and the second cross bar 82. As a result of the shortened third cross bar 83, the second support beams 86 may be more closely spaced from one another than are the first support beams 85. A trapeze frame pole 88 extends upwardly from the third cross bar 83. The trapeze frame pole 88 may also extend through holes formed in each of the second cross bar 82 and the third cross bar 83 and may be coupled to the first cross bar 81 at one end thereof. A trapeze boom 90 is pivotally received on the trapeze frame pole 88. A spring loaded locking pin 91 cooperates with locking apertures 92 formed in the trapeze frame pole 88 to lock the trapeze boom 90 in a desired position. A trapeze handle and strap assembly 94 depends from the trapeze boom 90.

In operation, the bariatric patient management system 10 can be configured in a plurality of positions. The actuators 62 can be used to raise and lower the backrest section 20, the middle section 22, the leg section 24, the foot section 26, or any combination thereof. Accordingly, any of the backrest section 20, the middle section 22, the leg section 24, the foot section 26, or any combination thereof may be caused to be raised or lowered with respect to the remainder of the main frame 12 to cause the mattress supporting surface height to be raised or lowered with respect to a ground surface on which the bariatric patient management system 10 rests. A trendelenburg position and a reverse trendelenburg position are also facilitated by operation of the actuators 62. The bariatric patient management system 10 can be configured as a chair to place the patient in a seated position. It should further be understood that any combination of positions of the backrest section 20, the middle section 22, the leg section 24, and the foot section 26 may be achieved depending on a size, placement, orientation, and arrangement of the actuators 62, the actuator arms 64, and the linkage members 66.

The trapeze boom 90 is pivotally received on the trapeze frame pole 88. Thus, during patient evaluation or ingress/egress, the trapeze boom 90 can be pivoted to either side and the spring loaded locking pin 91 may be inserted in the locking apertures 92 to lock the trapeze boom 90 in the desired position. The trapeze support structure 80 differs from the prior art trapeze boom supporting structures because the trapeze frame pole 88 extends away from the remainder of the trapeze support structure 80 from a height that is disposed below an uppermost surface of the headboard 14. Specifically, the third cross bar 83 is disposed below an uppermost surface of the headboard 14 to cause only the single trapeze frame pole 88 to extend between the headboard 14 and the trapeze boom 90. In contrast, many of the prior art trapeze booms included two or more support structures meeting adjacent the trapeze boom 90, causing additional structures that resulted in limited access to a patient resting on a bariatric patient bed. The trapeze support structure 80 shown in FIGS. 1 and 4 allows an operator of the bariatric patient management system 10 to simply reach around the single trapeze frame pole 88 to access the patient while also allowing for the trapeze boom 90 itself to be further rotated if the trapeze boom 90 or the trapeze handle and strap assembly 94 is also causing an obstacle to a health care provider in need of access to the patient.

Use of the side pull out extensions 38 facilitates a widening and narrowing of the mattress supporting surface of the bariatric patient management system 10. Use of the end pull out extension 44 facilitates a lengthening and shortening of the support surface of the bariatric patient management system 10. The ability to change the length and width of the bariatric patient management system 10 facilitates supporting a larger patient, thus maximizing the comfort of the patient. The ability to change the length and width of the bariatric patient management system 10 also facilitates transport of the bariatric patient management system 10 as desired. For example, the ability to change the length and width of the bariatric patient management system 10 may aid in navigating the bariatric patient management system through narrow doorways, constricted spaces within an elevator, or hallways having several obstacles disposed therein. During times of emergency or evacuation, health care providers may not have the time necessary to transfer a patient to a wheel chair or other transporting device. By providing a quick and easy adjustment method, safety and flexibility of transport are maximized.

Figure 5:
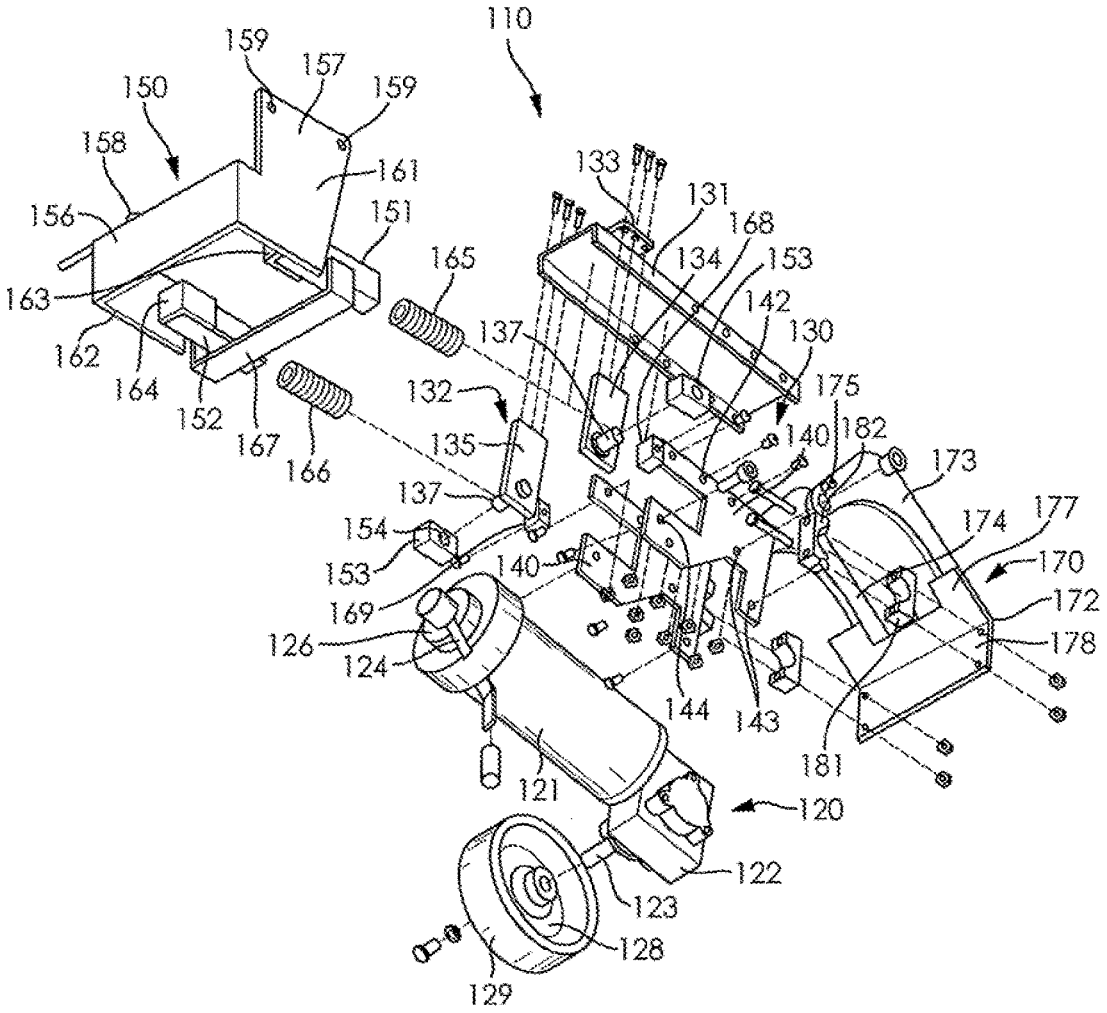
FIG. 5 is a partially exploded bottom perspective view of a drive system for use with the bariatric patient management system illustrated in FIG. 1.
Figure 6:
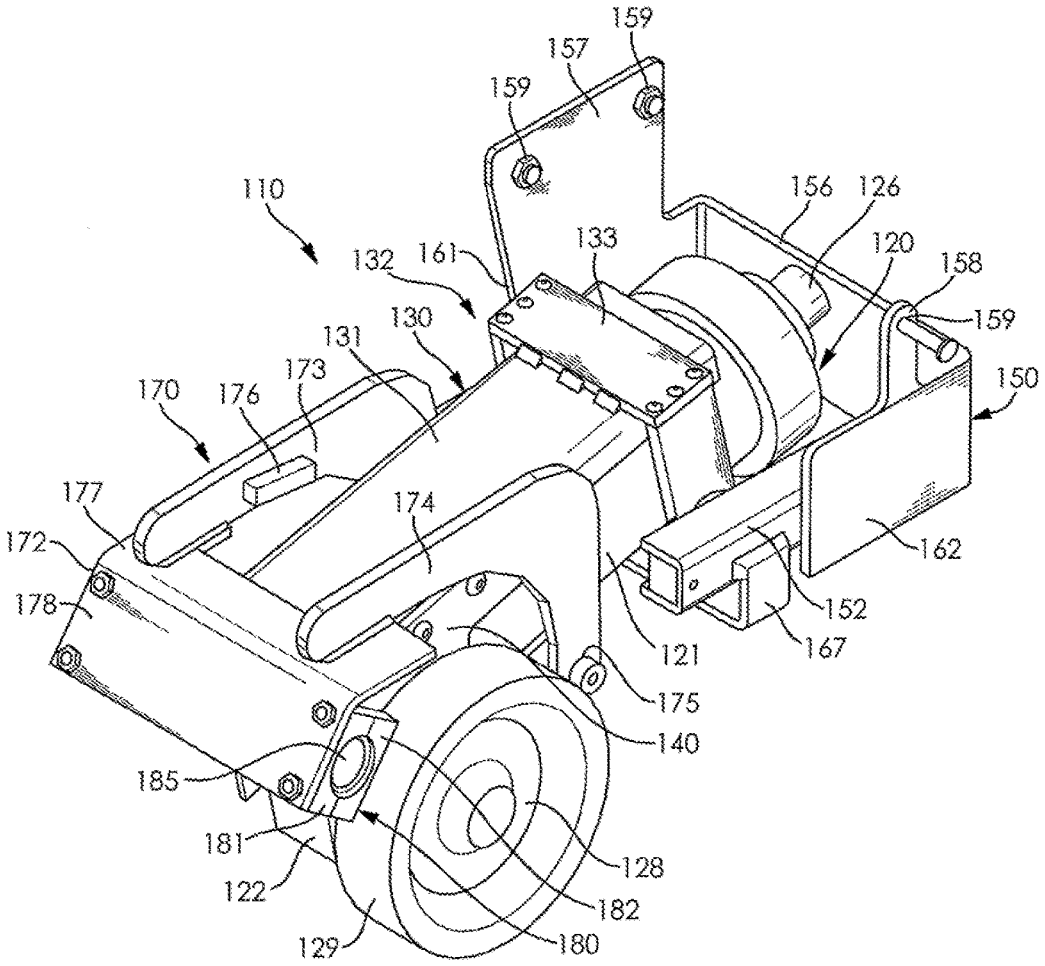
FIG. 6 is a top perspective view of the drive system illustrated in FIG. 5.

The bariatric patient management system 10 is further equipped with a single wheel drive system 110 disposed on and coupled to an underside of the main frame 12, as best shown in FIG. 3. The single wheel drive system 110 is configured to engage a floor surface under the bariatric patient management system 10 to aid a healthcare provider in propelling the bariatric patient management system 10 in forward and backward directions. As best shown in FIGS. 5 and 6, the single wheel drive system 110 comprises a drive actuator 120, a wheel 128, a motor mount assembly 130, a spring assembly 150, and a toggle mount assembly 170.

The drive actuator 120 illustrated in FIGS. 5 and 6 comprises a bi-directional gear motor, but it should be understood that any type of motor suitable for propelling the bariatric patient management system 10 in forwards and backwards directions and for communicating with an electrical system and control system thereof may be used without departing from the scope of the present invention. The gear motor may include a substantially cylindrical motor housing 121 having an electric motor (not shown) disposed therein. The motor housing 121 may include a reduction gear train housing 122 extending from one end thereof and a manual release brake 124 extending from a second end thereof. The reduction gear train housing 122 includes a rotor 123 extending therefrom in a direction perpendicular to a longitudinal axis of the motor housing 121 and substantially parallel to the ground surface. The wheel 128 is disposed on the rotor 123 and includes a tire 129 disposed thereon. The tire 129 may have any suitable tread pattern formed thereon for engaging the floor surface when the single wheel drive system 110 is in use. The wheel 128 has an axis of rotation that extends in a direction perpendicular to the longitudinal axis of the bariatric patient management system 10 and parallel to the ground surface.

The drive actuator 120 may include an automatic brake 126 or other locking device configured to automatically engage any time the drive actuator 120 is not in operation to ensure that the bariatric patient management system 10 is not accidentally propelled when not in use. The manual release brake 124 may be configured to override the automatic brake 126 of the drive actuator 120 when rotated to a released position, allowing for the bariatric patient management system 10 to be moved without the use of the drive actuator 120 when the tire 129 of the wheel 128 is engaged with the ground surface, as desired.

The drive actuator 120 may be powered by at least one rechargeable battery 125 disposed on an underside of the frame 12 and in electrical communication with the drive actuator 120. The rechargeable battery 125 may be configured to store electrical energy while in electrical communication with a traditional wall socket, for example. The rechargeable battery 125 may be connected electrically to a battery charger 194, which may then be plugged into a traditional wall socket. The drive actuator 120 and the rechargeable battery 125 may be equipped with an A/C cutoff feature to prevent the drive actuator 120 from being activated while the rechargeable battery 125 is being recharged. The rechargeable battery 125 may be used to power other electrical components of the bariatric patient management system 10, such as the actuators 62 and the weight display unit 76, for example. The embodiment shown in FIG. 3 includes one rechargeable battery 125 for powering the drive actuator 120 and one rechargeable battery 125 for controlling other components of the bariatric patient management system 10, such as the actuators 62, but other configurations may be used, as desired.

The drive actuator 120 is partially enclosed within the motor mount assembly 130. The motor mount assembly 130 comprises a support bracket 131, a pivot block assembly 132, and a pair of motor-mount side plates 140. The support bracket 131 is substantially rectangular in shape and is disposed above and extending in a longitudinal direction of the motor housing 121 of the drive actuator 120. The support bracket 131 is shown in FIG. 5 as a shallow C-channel partially shrouding the motor housing 121 of the drive actuator 120.

The pivot block assembly 132 is formed from a mounting block 133, a first motor pivot block 134, and a second motor pivot block 135, each of which is rectangular in shape. The mounting block 133 is disposed on and coupled to the support bracket 131 adjacent one end thereof and may be coupled to the support bracket 131 by any known coupling means, including welding and threaded fasteners, for example. The mounting block 133 is arranged in a direction perpendicular to the longitudinal axis of the support bracket 131 and each end of the mounting block 133 extends laterally beyond each respective side surface of the support bracket 131. The first motor pivot block 134 is coupled to one end of the mounting block 133 and the second motor pivot block 135 is coupled to the other end of the mounting block 133. The coupling of the first motor pivot block 134 and the second motor pivot block 135 to the mounting block 133 may be accomplished using any suitable coupling means, including the use of threaded fasteners, for example. The first motor pivot block 134 and the second motor pivot block 135 extend from the mounting block 133 in a direction toward the motor housing 121 of the drive actuator 120 and perpendicular to the longitudinal axis of the support bracket 131 to partially surround the motor housing 121.

The first motor pivot block 134 and the second motor pivot block 135 each include a pin 137 extending laterally outward therefrom. The pin 137 may extend through an aperture formed in the free end of either of the first motor pivot block 134 or the second motor pivot block 135. The pin 137 extending from the first motor pivot block 134 and the pin 137 extending from the second motor pivot block 135 are aligned with each other to share a common axis of rotation.

Each of the motor-mount side plates 140 may be irregularly shaped with at least two indented portions as shown in FIG. 5, but it should be understood that the motor-mount side plates 140 may have any suitable shape, including a rectangular shape, for example. Each of the motor-mount side plates 140 may include at least one bracket aperture 142 formed along one longitudinal edge thereof, at least one motor mounting aperture 143 formed adjacent one corner thereof, and a motor toggle aperture 144 formed adjacent a second corner thereof. The motor-mount side plates 140 may be securely coupled to a respective longitudinal side of the support bracket 131 by any known coupling means, including the use of fasteners disposed through at least one of the bracket apertures 142 and at least one corresponding aperture formed in the support bracket 131. The motor-mount side plates 140 extend in a direction toward the motor housing 121 of the drive actuator 120 and perpendicular to the support bracket 131 to partially surround the drive actuator 120 in similar fashion to the first motor pivot block 134 and the second motor pivot block 135. The reduction gear train housing 122 of the drive actuator 120 may be coupled to the motor-mount side plates 140 on each side thereof be means of fasteners disposed through the at least one motor mounting aperture 143 and at least one corresponding aperture formed in the reduction gear train housing 122 adjacent the rotor 123, thereby coupling the drive actuator 120 to the motor mount side plates 140. The rotor 123 may extend through one of the indented portions of one of the motor-mount side plates 140 to position the wheel 128 outside of and to one side of the motor mount assembly 130.

The spring assembly 150 comprises a first spring guide 151, a second spring guide 152, a mounting bracket 156, and a cross-support 167. The mounting bracket 156 is substantially U-shaped and extends around a portion of the motor housing 121 formed opposite the reduction gear train housing 122. The mounting bracket 156 may include a first projecting portion 157 extending outwardly from a first side portion 161 thereof and a second projecting portion 158 extending outwardly from a second side portion 162 thereof. A distal end of each of the projecting portions 157, 158 may include at least one mounting aperture 159 formed therein. However, the mounting bracket 156 may have any suitable shape and the at least one mounting aperture 159 may be formed in any portion of the mounting bracket 156 suitable for mounting the mounting bracket 156 to a portion of the frame 12 of the bariatric patient management system 10, as desired.

The first spring guide 151 is coupled to an interior surface of the first side portion 161 and the second spring guide 152 is coupled to an interior surface of the second side portion 161. The first spring guide 151 and the second spring guide 152 may each be C-channels that extend in a direction substantially parallel to the longitudinal axis of the motor housing 121, wherein the open side of each C-channel faces toward the motor housing 121. The first spring guide 151 extends along a first side of the motor housing 121 and the second spring guide 152 extends along a second opposite side thereof. The cross support 167 extends between and is coupled to each of the first spring guide 151 and the second spring guide 152 to provide additional support to the spring assembly 150. The cross-support 167 is also arranged to be disposed beneath at least a portion of the motor housing 121, causing the motor housing 121 to be surrounded on all four sides adjacent the end of the motor housing 121 having the manual release brake 124. The first spring guide 151 includes a first spring stop 163 formed at an end thereof coupled to the interior surface of the first side portion 161 and a second spring stop 168 formed at an opposite end thereof. The second spring guide 152 includes a third spring stop 164 formed at an end thereof coupled to the interior surface of the second side portion 162 and a fourth spring stop 169 formed at an opposite end thereof.

Each of the first spring guide 151 and the second spring guide 152 has a sliding block 153 slidably disposed within the C-channel formed therein. The sliding block 153 of the first spring guide 151 is disposed between the first spring stop 163 and the second spring block 168 and the sliding block 153 of the second spring guide 152 is disposed between the third spring stop 164 and the fourth spring stop 169. Each of the spring stops 163, 164, 168, 169 restricts a range of motion of the sliding blocks 153 within the first spring guide 151 and the second spring guide 152, respectively. The sliding block 153 includes a pivot aperture 154 formed therethrough. As explained hereinabove, the first motor pivot block 134 and the second motor pivot block 135 each include a pin 137 extending laterally outward therefrom. The pivot aperture 154 formed in each of the sliding blocks 153 is configured to rotatably receive one of the pins 137 therein. A first spring 165 is disposed within the C-channel of the first spring guide 151 between the first spring stop 163 and the second spring stop 168, and more particularly between the first spring block 163 and the sliding block 153 of the first spring guide 151. A second spring 166 is disposed within the C-channel of the second spring guide 152 between the third spring stop 164 and the fourth spring stop 169, and more particularly between the third spring stop 164 and the sliding block 153 of the second spring guide 152. The first spring 165 and the second spring 166 are each configured to apply a force to each corresponding sliding block 153 in a direction away from the first spring stop 163 and the third spring stop 164, respectively, when the first spring 165 and the second spring 166 undergo compression, respectively. Accordingly, each of the pins 137 is rotatably disposed within one of the pivot apertures 154 to allow the drive actuator 120 and the motor mount assembly 130 to rotate relative to the spring assembly 150. Additionally, the drive actuator 120 and the motor mount assembly 130 may also slide relative to the spring assembly 150 due to the ability of the sliding blocks 153 to slide within the first spring guide 151 and the second spring guide 152. The ability of the drive actuator 120 and the motor mount assembly 130 to both rotate and slide relative to the spring assembly 150 allows the tire 129 of the wheel 128 to maintain contact with the ground surface as the height and contour of the ground surface changes while the bariatric patient management system 10 is translated along the ground surface.

The toggle mount assembly 170 comprises a toggle bracket 172, a first pivot arm 173, a second pivot arm 174, and at least one fulcrum collar 180. The first pivot arm 173 and the second pivot arm 174 may each be substantially L-shaped and have an aperture 175 formed adjacent one end thereof. The first pivot arm 173 is rotatably coupled to one of the motor-mount side plates 140 via a fastener disposed through the aperture 175 formed in the first pivot arm 173 and one of the motor toggle apertures 144 formed in one of the motor-mount side plates 140. The second pivot arm 174 is rotatably coupled to the other one of the motor-mount side plates 140 via a fastener disposed through the aperture 175 formed in the second pivot arm 174 and one of the motor toggle apertures 144 formed in the other one of the motor-mount side plates 140. However, the first pivot arm 173 and the second pivot arm 174 may be rotatably coupled to the motor-mount side plates 140 using any known rotatable coupling means, as desired. As shown in FIG. 6, one or both of the first pivot arm 173 and the second pivot arm 174 may include a stop block 176 formed thereon and extending laterally inward past an upper surface of the support bracket 131 of the motor mount assembly 130. The stop blocks 176 are configured to limit a range of motion of the first pivot arm 173 and the second pivot arm 174 when the stop blocks 176 are brought into contact with the upper surface of the support bracket 131. The stop blocks 176 prevent the toggle mount assembly 170 from interfering with the wheel 128 of the single wheel drive system 120 while also restricting a range of motion of the toggle mount assembly 170 to ensure that the single wheel drive system 110 maintains engagement with the floor surface, as described with greater detail hereinafter.

The toggle bracket 172 may be a bent plate having a first planar portion 177 and a second planar portion 178. The second planar portion 178 may be angled relative to the first planar portion 177 by an angle between 0 and 90 degrees, for example. The first planar portion 177 is coupled to each of the first pivot arm 173 and the second pivot arm 174 by any suitable coupling means, including the use of fasteners or a welding process, for example. The at least one fulcrum collar 180 is coupled to the second planar portion 178 by any suitable means, including the use of threaded fasteners, for example. The at least one fulcrum collar 180 may be formed from a first collar portion 181 having a semi-circular indentation formed therein and a second collar portion 182 also having a semi-circular indentation formed therein. The semi-circular indentations cooperate to form a cylindrical aperture 185 extending through each of the at least one fulcrum collars 180. The toggle mount assembly 170 is illustrated as including two of the fulcrum collars 180 disposed at each longitudinal end of the second planar portion 178 of the toggle bracket 172, but it should be understood that any number of the fulcrum collars 180 may be used, including the use of one elongated fulcrum collar 180 or three or more fulcrum collars 180, as desired.

Referring back to FIG. 3, the single wheel drive system 110 is coupled to the remainder of the bariatric patient management system 10 by means of the mounting apertures 159 formed in the mounting bracket 156 and the cylindrical apertures 185 formed in the fulcrum collars 180. As described hereinabove, the mounting bracket 156 may include the first projecting portion 157 having at least one of the mounting apertures 159 formed therein and the second projecting portion 158 having at least one of the mounting apertures 159 formed therein. A conventional fastener such as a pin or a bolt may be received through each of the mounting apertures 159 and through a corresponding aperture formed in a portion of the main frame 12 to rigidly couple the mounting bracket 156 of the spring assembly 150 to the portion of the main frame 12. The mounting bracket 156 is rigidly coupled to the portion of the main frame 12 in a manner that does not allow the spring assembly 150 to move relative thereto during operation of the single wheel drive system 110. In contrast, the cylindrical apertures 185 formed in the fulcrum collars 180 receive a cylindrical portion of the main frame 12 therein to rotatably couple the toggle mount assembly 170 to the portion of the main frame 12. The cylindrical portion of the main frame 12 may be a rod 13 extending perpendicular to a longitudinal axis of the bariatric patient management system 10.

The single wheel drive system 110 may be coupled to a portion of the main frame 12 that is movable relative to the remainder of the main frame 12 during actuation of the actuators 62. For example, the single wheel drive system 110 may be coupled to one of the backrest section 20, the middle section 22, the leg section 24, the foot section 26, or any combination thereof to cause the single wheel drive system 110 to be movable relative to both a stationary portion of the main frame 12 supported by the casters 18 and to the ground surface. Accordingly, the wheel 128 of the single wheel drive system 110 may be caused to engage the ground surface by adjusting the height or orientation of any of the backrest section 20, the middle section 22, the leg section 24, the foot section 26, or any combination thereof, such as by changing a height of the entirety of the mattress supporting surface. Accordingly, the single wheel drive system 110 may be configured to only engage the ground surface when the mattress supporting surface is adjusted to be in a lowermost position relative to the ground surface. In contrast, it should be understood that the single wheel drive system 110 could be coupled to a portion of the main frame 12 that remains relatively stationary during actuation of the actuators 62, such as the portion of the main frame 12 supported by the casters 18, but the ability to disengage the wheel 128 from the ground surface by adjustment of the actuators 62 is lost. Still, in other embodiments of the invention, one of the spring assembly 150 and the toggle mount assembly 170 may be coupled to a relatively stationary portion of the main frame 12 while the other assembly is coupled to a portion of the main frame 12 moveable relative to the stationary portions thereof, for example.

The single wheel drive system 110 may be coupled to the main frame 12 wherein the wheel 128 is positioned along the longitudinal axis of the bariatric patient management system 10 and is equally spaced apart from each longitudinal side thereof. As illustrated in FIG. 3, the wheel 128 may be offset from a central region of the bariatric patient management system 10 in the longitudinal direction thereof wherein the wheel 128 is positioned more closely to the footrest section 26 than to the backrest section 28. In any case, the wheel 128 of the single wheel drive system 110 is disposed at a position on the underside of the frame 12 wherein the wheel 128 is surrounded by a quadrilateral shape formed by the cooperation of the four casters 18 disposed adjacent each or the four corners of the frame 12.

Figure 7:
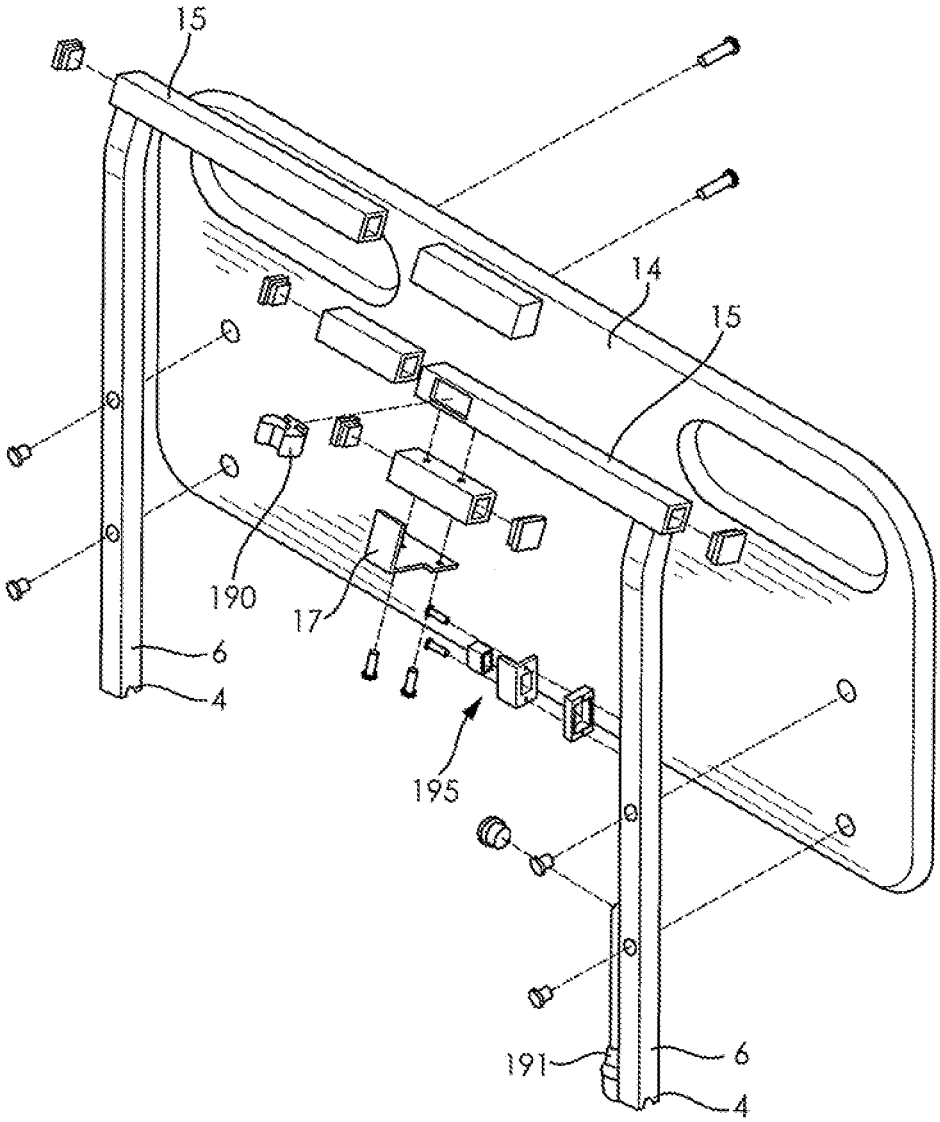
FIG. 7 is a partially exploded top perspective view of a headboard and handlebars that are removably coupled to a frame of the bariatric patient management system illustrated in FIG. 1, wherein one of the handlebars includes a variable control joystick disposed thereon for controlling the drive system illustrated in FIGS. 5 and 6.

Referring now to FIG. 7, a variable control joystick 190 for controlling the single wheel drive system 110 is shown. The headboard 14 of the bariatric patient management system 10 may include a pair of substantially L-shaped handlebars 15 coupled thereto. The variable control joystick 190 may be disposed on a rearward facing surface of one of the handlebars 15 as illustrated in FIG. 7, but the variable control joystick 190 may be disposed on any surface of the handlebars 15 or the headboard 14, including forward or rearward facing surfaces thereof, upward or downward facing surfaces thereof, and side surfaces thereof, for example. A guard panel 17 disposed on the handlebar 15 may extend partially or entirely around the variable control joystick 190 to prevent accidental manipulation thereof when the bariatric patient management system 10 is in use. If the variable control joystick 190 is disposed directly on the headboard 14, the guard panel 17 may also be disposed directly on the headboard 14 as well. The variable control joystick 190 is shown as being actuated in left and right horizontal directions, but the variable control joystick 190 may be oriented and actuated in any direction, including being actuated in an up and down vertical direction, for example.

The variable control joystick 190 is in electrical communication with a first cable 191 extending therefrom and toward a second cable (not shown). The first cable 191 may be routed through a hollow portion of the handlebar 15 to which it is coupled to militate against the first cable 191 being exposed to the environment during use of the bariatric patient management system 10. In other embodiments where the variable control joystick is mounted directly to the headboard 14, the first cable 191 may be routed through the headboard 14 itself before then being routed through a vertically extending portion of the headboard 14 and toward the main frame 12. The first cable 191 may be removably coupled to the second cable adjacent a mounting position of the handlebar 15 on the remainder of the main frame 12, which is indicated in FIGS. 1 and 7 by reference numeral 4. The first cable 191 and the second cable may include mating features that are configured to be coupled to each other by pressing an end of the first cable 191 into an end of the second cable, such as a traditional electrical plug and socket arrangement, for example. The second cable may then extend from the handlebar junction 4 and toward a motor control system 193 of the single wheel drive system 110. The second cable may be routed within or along a portion of the frame 12 extending from the handlebar junction 4 and toward the motor control system 193. The motor control system 193 may be disposed on an underside of the main frame 12 and may be housed in the same enclosure as the battery charger 194, as shown in FIG. 3, and may be configured to analyze a control signal sent from the variable control joystick 190 through the first cable 191 and the second cable to determine a speed and rotational direction that the motor of the single wheel drive system 110 is to turn the wheel 128 to propel the bariatric patient management system 10 in a desired direction, such as forward motion or reverse motion. In some embodiments, it should be understood that the controller 67 used to control the actuators 62 may also be configured to control the single wheel drive system 110, as desired.

The headboard 14 is removably coupled to the main frame 12 to facilitate better access to a patient during use of the bariatric patient management system 10. Each of the L-shaped handlebars 15 of the headboard 14 include a vertically arranged portion 6 configured to be received within a vertically arranged channel 8 formed within a portion of the main frame 12. The headboard 14 may accordingly be removed from the remainder of the main frame 12 by pulling the handlebars 15 upwards and out of the vertically arranged channel 8, as no locking means are used to retain the vertically arranged portions 6 of the handlebars 15 within the vertically arranged channel 8. Because the first cable 191 is removably coupled to the second cable adjacent a junction 4 of the vertically arranged portion 6 of the handlebar 15 and the vertically arranged channel 8 of the main frame 12, the removal of the headboard 14 also facilitates a decoupling of the first cable 191 from the second cable. The removable coupling of the first cable 191 and the second cable allows for the variable control joystick 190 to be easily disconnected from the single-wheel drive system 110 when the headboard 14 is removed from the main frame 12. The removable coupling of the first cable 191 and the second cable provides an additional safety feature as the bariatric patient management system 10 cannot be accidentally propelled forwards or backwards by the single-wheel drive system 110 when a health care provider is addressing the patient when the headboard 14 has been removed from the main frame 12.

The variable control joystick 190 is configured to be adjusted between various positions indicating forward motion, reverse motion, and no motion of the bariatric patient management system 10. For instance, adjusting the variable control joystick 190 to a fully forward position indicates that the operator desires for the bariatric patient management system 10 to move forward at a maximum speed while adjusting the variable control joystick 190 to a fully reverse position indicates that the operator desires for the bariatric patient management system 10 to move in reverse at a maximum speed. The maximum speed in each direction may be limited by the available power delivered by the single wheel drive system 110 or the maximum speed may be intentionally limited in each direction based on programming associated with control of the single wheel drive system 110. The limiting of the speed of the single wheel drive system 110 may be used as a safety feature to prevent extreme speeds or to aid a user in maintaining control of the bariatric patient management system 10. An adjustment of the variable control joystick 190 to a position intermediate the fully forward position and the fully backward position indicates that the bariatric bed is to remain at rest. Positioning the variable control joystick 190 between the intermediate position and the fully forward position or the fully backward position causes the bariatric patient management system 10 to move in either the forward direction or the reverse direction at infinitely various intermediate speeds. Accordingly, the variable control joystick 190 may be configured to provide analog control of the speed of the bariatric patient management system 10. As shown in FIG. 7, the variable control joystick 190 may be a switch capable of being tilted to a rightward position or a leftward position, wherein each direction indicates one of forward or reverse motion. In other embodiments, the variable control joystick 190 may be oriented vertically, wherein upward and downward tilting of the variable control joystick 190 indicates one of forward or reverse motion. It should be understood that any form of joystick or other control mechanism capable of being adjusted bi-laterally may be used, as desired. However, it should also be understood that the use of the single wheel drive system 110 only requires that the variable control joystick 190 has single axis control, rather than dual axis control, due to the arrangement of the casters 18 and the wheel 128 of the single wheel drive system 110.

Referring back to FIGS. 1-3, each of the casters 18 of the bariatric patient management system 10 may include a caster adjustment mechanism 5. The caster adjustment mechanism 5 is shown as a lever extending from the main frame 12 adjacent each of the casters 18. Each of the caster adjustment mechanisms 5 is configured to be adjustable to three different settings by changing a tilt of each of the caster adjustment mechanisms 5 relative to the ground surface. The three different settings are a steer setting, a neutral setting, and a brake setting, wherein the neutral setting may be achieved when the caster adjustment mechanism 5 is arranged parallel to the ground surface and the steer and brake settings may be achieved when the caster adjustment mechanism 5 is tilted to either side of the parallel arrangement. The caster adjustment mechanism 5 may be a conventional plunger-style three-setting caster system, but it should be understood that any known three-setting caster arrangement as known in the art may be utilized without departing from the scope of the invention.

The caster adjustment mechanism 5 of each of the casters 18 may be mechanically linked to each other and manually or automatically controlled, as desired. The linking of the caster adjustment mechanisms 5 facilitates the use of the three distinct steering settings. When in the brake setting, all four of the casters 18 are locked due to pressure placed thereon from a brake pad (not shown) or other locking mechanism disposed within each of the casters 18. When in the steer setting, the casters 18 formed adjacent the footboard 16 are unable to swivel and are maintained in a position aligned parallel to a longitudinal axis of the bariatric patient management system 10 while the casters 18 formed adjacent the headboard 14 are able to swivel freely. The steer setting causes the casters 18 formed adjacent the footboard 16 to only roll in one of a straight forward direction and a straight backwards direction while the casters 18 formed adjacent the headboard 14 are able to be swiveled and moved in a direction transverse to the longitudinal axis of the bariatric patient management system 10. As such, the bariatric patient management system 10 can be maneuvered by grasping the handlebars 15 and applying force in a direction transverse to the longitudinal axis of the bariatric patient management 10 to change a lateral position of the headboard 14 end thereof, thereby changing a direction in which the bariatric patient management system 10 is pointed and being propelled by the single wheel drive system 110. The steer setting allows for a healthcare provider to maneuver the bariatric patient management system 10 as desired while also providing the added benefit of allowing the bariatric patient management system 10 to be propelled in a substantially straight forwards or backwards direction due to the locking of the casters 18 formed adjacent the footboard 16 thereof.

When in the neutral setting, all four of the casters 18 are unrestrained and the caster 18 may swivel and roll in any desired direction. The bariatric patient management system 10 may accordingly be steered when in the neutral setting in similar fashion to the steering thereof when in the steer setting. The ability of all four casters 18 to swivel freely adds additional maneuverability to the bariatric patient management system 10. However, the bariatric patient management system 10 may not be able to be propelled in a consistently straight direction due to the swivel action of all four casters 18. Accordingly, a healthcare provider may selectively choose between the steer setting and the neutral setting depending on the application and the desired maneuverability of the bariatric patient management system 10.

In operation, the rechargeable battery 125 is connected to the battery charger 194, which is capable of being plugged into a traditional wall socket in order to store electrical energy in the rechargeable battery 125 for powering the electrical components of the bariatric patient management system 10, including the single wheel drive system 110. After unplugging the battery charger 194, the single wheel drive system 110 may be turned on by activating a power switch 195 in electrical communication with the drive actuator 120, wherein the power switch 195 may be disposed on any of the drive actuator 120, the handle bar 15 adjacent the variable control joystick 190, and any other portion of the frame 12, as non-limiting examples. As explained hereinabove, activation of the single wheel drive system 110 also requires that the vertical arranged portions 6 of the handlebars 15 are disposed within the vertically arranged channels 8 extending from the main frame 12 to couple the first cable 191 extending from the variable control joystick 190 to the second cable extending from the motor control system 193. Furthermore, the mattress supporting surface of the bariatric patient management system 10 may be placed in a lowermost position using the actuators 62 to place the tire 129 of the wheel 128 in contact with the ground surface.

The caster adjustment mechanisms 5 are then adjusted to remove the casters 18 from the brake setting and to place the casters 18 into one of the steer setting and neutral setting, each of which allow the casters 18 to roll on the ground surface while also ensuring that at least two of the casters 18 are cable of swiveling on the ground surface. A healthcare provider may then grasp the handlebars 15 with one hand placed on the variable control joystick 190 in a position suitable for rotating the variable control joystick 190 bi-directionally. The variable control joystick 190 may be configured wherein rotation thereof in a rightward or upward direction causes the single wheel drive system 110 to propel the bariatric patient management system 10 forwards while rotation of the variable control joystick 190 in a leftward or downward direction causes the single wheel drive system 110 to propel the bariatric patient management system 10 in the reverse direction. The healthcare provider may further steer the bariatric patient management system 10 using the handlebars 15, which are disposed at an end of the bariatric patient management system 10 having the casters 18 set to be swiveled relative to the ground surface.

When the healthcare provider adjusts the variable control joystick 190, a control signal is sent via the first cable 191 and the second cable to the motor control system 193, which in turn sends a control signal to the drive actuator 120. The drive actuator 120 causes the rotor 123 to drive the wheel 128 to rotate in one of two directions. Upon activation of the drive actuator 120, an automatic braking or locking mechanism associated with the drive actuator 120 may be ceased from operating by the motor control system 193. The single wheel drive system 110 utilizes electrical energy stored in the rechargeable battery 125 to drive the motor of the drive actuator 120.

When the wheel 128 is engaged with the ground surface, each of the sliding blocks 153 may be slidably displaced within each of the first spring guide 151 and the second spring guide 152 in a direction toward the first spring stop 163 and the third spring stop 164. This displacement in turn compresses the first spring 165 and the second spring 166, respectively, causing the first spring 165 and the second spring 166 to apply a force on the sliding blocks 153 in a direction towards the wheel 128. As shown in FIG. 6, the motor mount assembly 130 and the drive actuator 120 may be normally angled with respect to the ground surface. Accordingly, because the sliding blocks 153 are rotatably coupled to the motor mount assembly 130 via the pins 137, the forces applied by the first spring 165 and the second spring 166 to the sliding blocks 153 aid in maintaining contact between the wheel 128 and the ground surface by forcing the wheel 128 in a partially downwards direction.

Furthermore, the rotatable connection of the toggle mount assembly 170 with the frame 12 in conjunction with the rotatable connection of the pin 137 of the motor mount assembly 130 with the sliding blocks 153 allows for the wheel 128 to remain engaged with the ground surface when the wheel 128 is carried over surface features such as doorway thresholds and depressions, as non-limiting examples. The rotatable connections allow the wheel 128 to be translated upwards and downwards relative to the casters 18 and the frame 12 while the first spring 165 and the second spring 166 continually ensure that wheel 128 remains in contact with the ground surface. Additionally, the stop blocks 176 further ensure that the motor mount assembly 130 does not rotate to a position relative to the toggle mount assembly 170 wherein the wheel 128 are no longer engaged with and pressed towards the ground surface by the first spring 165 and the second spring 166.

From the foregoing description, one ordinarily skilled in the art can easily ascertain the essential characteristics of this invention and, without departing from the spirit and scope thereof, can make various changes and modifications to the invention to adapt it to various usages and conditions.

We claim:

1. A patient management system comprising:
a frame;
a drive system coupled to the frame, the drive system including a wheel for engaging a floor surface and an actuator for driving the wheel;
a controller configured to control the actuator;
a headboard removably coupled to the frame; and
a switch configured to provide control of the drive system, wherein the switch is disposed on the headboard and is configured to send a control signal to the controller through a first electrical connector mounted on the headboard and a second electrical connector mounted on the frame, wherein the first electrical connector is routed through an opening formed in a handlebar of the headboard.

2. The patient management system of claim 1, wherein removal of the headboard from the frame causes the first electrical connector to be disconnected from the second electrical connector to cease operation of the actuator.

3. The patient management system of claim 2, wherein at least a portion of the headboard is removably received within an opening formed in the frame adjacent a junction of the first electrical connector and the second electrical connector.

4. The patient management system of claim 1, wherein one of the first electrical connector and the second electrical connector forms a socket and the other of the first electrical connector and the second electrical connector forms a plug configured to connect to the socket.

5. The patient management system of claim 1, wherein the first electrical connector is a first cable and the second electrical connector is a second cable.

6. The patient management system of claim 1, wherein the opening extends through the headboard to a portion of the headboard removably received within a portion of the frame.

* * * * *